United States Patent [19]

Vore

[11] Patent Number: 5,016,701

[45] Date of Patent: May 21, 1991

[54] WINDOW SHADE CONVEYOR SYSTEM

[76] Inventor: Danny D. Vore, Rte. 1, Box 192, Eaton, Ind. 47338

[21] Appl. No.: 569,856

[22] Filed: Aug. 20, 1990

[51] Int. Cl.[5] ..... A47H 5/00

[52] U.S. Cl. ..... 160/241; 160/310; 160/268.1

[58] Field of Search ..... 160/310, 311, 312, 272, 160/239, 241, 120; 226/171, 172

[56] References Cited

U.S. PATENT DOCUMENTS

| | | | |
|---|---|---|---|
| 3,853,167 | 12/1974 | Wardlaw | 160/133 |
| 4,606,157 | 8/1986 | Esposito | 160/310 X |
| 4,721,146 | 1/1988 | Wardlaw | 160/310 |
| 4,744,403 | 5/1988 | Hausmann | 160/272 |
| 4,864,783 | 9/1989 | Esposito | 160/310 X |

*Primary Examiner*—David M. Purol
*Assistant Examiner*—Korie H. Chan
*Attorney, Agent, or Firm*—Woodard, Emhardt, Naughton, Moriarty & McNett

[57] ABSTRACT

A window shade conveyor system for use with a window assembly having parallel frame members supporting a window pane therebetween, the frame members being non-vertically oriented, includes a shade roller rotatably disposed between the frame members at an upper portion of the frame members, the roller carrying a window shade wound thereon and adapted to be unwound to cover the window pane between frame members. A continuous drive shaft is supported between frame members adjacent the shade roller. Gearing is connected between the drive shaft and the roller to provide rotary motion to the roller to wind or unwind the window shade. A conveyor assembly is supported by each of the frame members, which conveyor assembly includes a rotatable driving member engaged to the drive shaft. An idler is supported at a portion of the frame member distal the driving member. A continuous conveyor belt is mounted between the driving member and the idler to form a continuous loop, whereby rotation of the driving member causes the conveyor belt to translate around the loop. The window shade is supported at its lateral edges by the conveyor belts at consecutive frame members. A relationship is maintained between the motion of the conveyor belt and the motion of the window shade so that the linear motion of the conveyor belt assists the window shade as it unwinds from the shade roller.

12 Claims, 13 Drawing Sheets

WINDOW SHADE CONVEYOR SYSTEM

BACKGROUND OF THE INVENTION

The present invention concerns window shades or sun shades and systems for conveying the shade between open and closed positions. In particular, the present invention is directed to windows that are non-vertical, such as an atrium type structure, slanted constructions and flat skylight treatments.

With typical vertical pane windows, window shades can be easily drawn to cover the window by simply pulling the shade vertically over the window. The force of gravity always maintains the shade in it proper orientation relative to the window and can assist the extension of the shade.

However, a special problem exists in designing systems to convey window shades for use with atrium-type windows. An atrium-type window includes a substantial portion of the window that is at an angle to the vertical. Windows of this type are popular because they permit more direct sunshine through the sloped window portions. While atrium-type windows are very aesthetically pleasing and provide greater light for the building interior, they also present significant problems in producing a system for extending and retracting a window shade over the angle portion. Since the force of gravity naturally tries to cause the shade to hang vertically, some apparatus must be present to keep the shade close to the window and to keep the shade from drooping or sagging along the angled length of the window. The system must also be capable of extending the window shade along the angled portion and permitting a transition to any vertical portion of the window.

SUMMARY OF THE INVENTION

The invention resides in a window shade conveyor system for use with a window assembly having parallel frame members supporting a window pane therebetween, the frame members being non-vertically oriented. The conveyor system comprises a shade roller rotatably supported between the frame members at an upper portion of the frame members, the roller carrying a window shade wound thereon and adapted to be unwound to cover the window pane between frame members. A drive shaft is supported under frame members with gearing between the drive shaft and the roller to provide rotary motion to the roller to wind or unwind the window shade. A conveyor assembly is supported by each of the frame members, which conveyor assembly includes a rotatable driving member engaged to the drive shaft. An idler is supported at a portion of the frame member distal the the driving member, which in the case of an atrium-type window structure is at a relatively lower portion of the frame member. For an atrium-type structure, the idler may be at the intersection between the vertical and angled portions of the window, or may be supported at the bottom edge of the window frame. A continuous conveyor belt is mounted between the driving member and the idler to form a continuous loop, whereby rotation of the driving member causes the conveyor belt to move linearly around the loop.

The invention includes gearing between the drive shaft and the shade roller. The shade roller and the driving member engaged to the drive shaft cooperate so that when the roller rotates to unwind the window shade, the driving member rotates to cause the conveyor belt to move linearly. The window shade is supported at its lateral edges by the conveyor belts at consecutive frame members. The shade may include lateral stays between the conveyor belts to support the shade so that it cannot fall vertically downward between the frame members when it is unwound from said roller. A relationship is maintained between the motion of the conveyor belt and the motion of the window shade so that the linear motion of the conveyor belt assists the window shade as it unwinds from the shade roller.

The driving member in one embodiment is a one-way clutch mounted on the drive shaft. The one-way clutch permits the conveyor belt to drive in one direction only. Thus, when the window shade is being unwound from the roller, the conveyor belt translates in the direction of the linear motion of the shade. However, when the window shade travels in the opposite direction as it is being rewound onto the roller, the one-way clutch does not transmit rotary motion from the drive shaft to the conveyor belt so the belt cannot push the window shade.

In another feature of the invention, a predetermined relationship between the linear speed of the conveyor belt and the fastest linear speed of the window shade as it is being unwound is maintained. The conveyor belt linear speed is maintained to be at least as fast as the fastest speed of the shade while it is being unwound from the shade roller. This linear speed relationship is maintained by a proper relationship between the rotational speeds and outer diameters of the shade roller and one-way clutch.

One benefit of the present invention is that it provides a window shade conveyor system for use with atrium-type, angled or flat skylight window sections. The invention also provides means to assist the travel of the window shade as it unwinds from the shade roller.

A further benefit of the invention is that it is readily adapted for use with multiple window bay arrangements. The present invention is adapted to simultaneously control the raising and lowering of window shades in several window bays with a single drive motor. A further benefit is that the conveyor system of this invention is not dependent upon the type of drive motor used - that is, the present invention is readily adapted for use with a mechanical crank, an external motor or a motor embedded within one of the shade rollers.

Other benefits of the present invention will become apparent upon consideration of the following written description and accompanying figures.

DESCRIPTION OF THE PREFERRED EMBODIMENT

Figure 1:
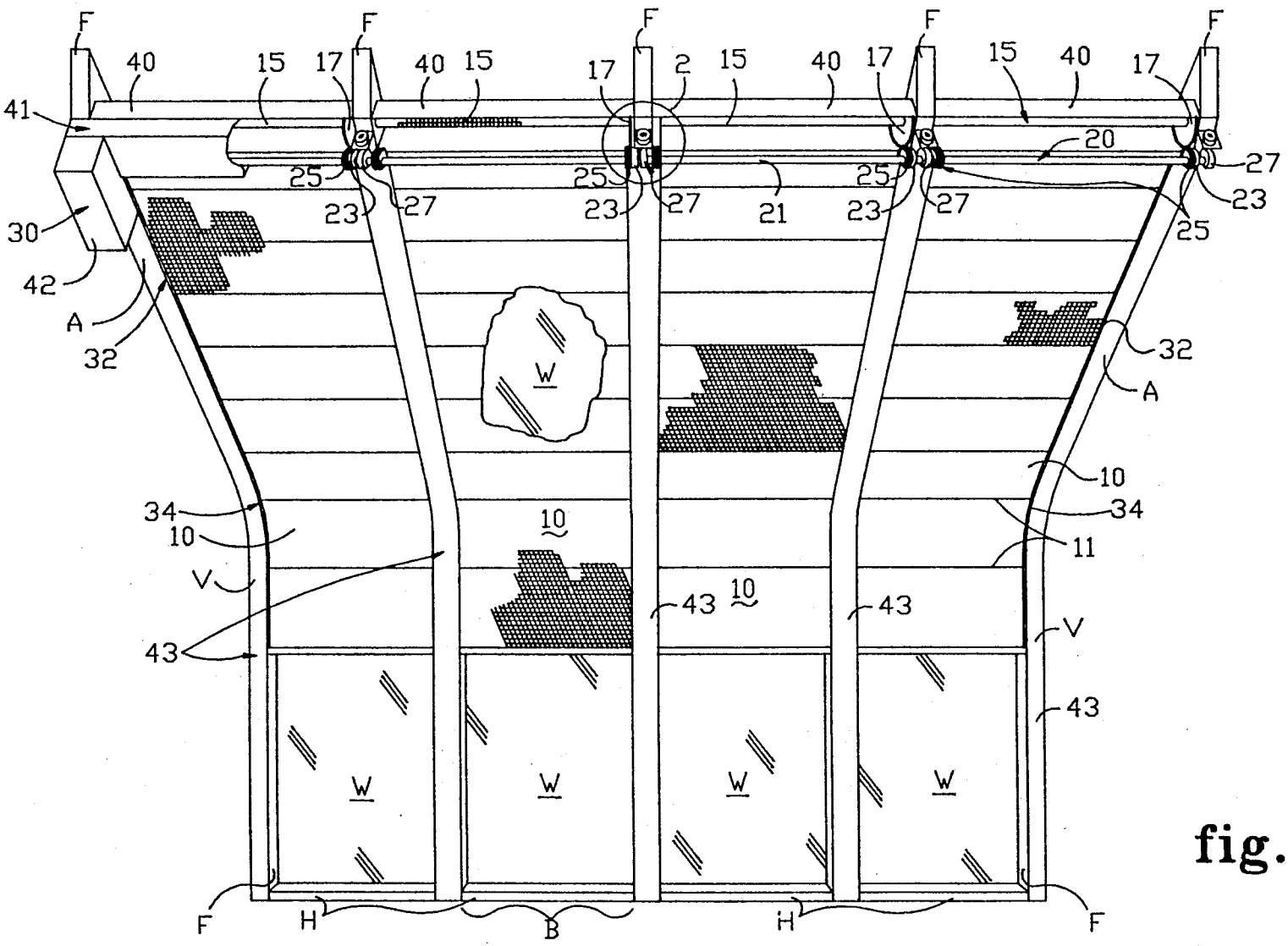
FIG. 1 is a front perspective view of an atrium-type window arrangement employing the window shade conveyor system of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

An atrium-type window arrangement includes a frame, designated as F in FIG. 1. The frame F includes a number of vertical members V that are interconnected at the top and bottom by horizontal members H. The vertical frame members V each include an angled portion A that forms the atrium portion of the window arrangement. Window panes W are supported between the frame members. A number of sun shades or window shades 10 are disposed between the frame members and arranged to be conveyed or contracted to cover the windows W. The window shades 10 include a number of horizontal stays 11 to keep the window shade 10 from sagging or curling.

The window shade 10 is wound onto a shade take-up roller 15 that is situated at the top of the window frame F. The take-up roller 15 is attached to a driven gear 17 which constitutes part of a means for providing rotary motion to the roller. A continuous drive shaft assembly 20 extends between the endmost frame members F and across the entire width of the window assembly. The drive shaft assembly includes a drive shaft 21 and a number of drive gears 23 affixed to the drive shaft and arranged to mesh with the several driven gears 17. A number of shaft clutches 25 are mounted on the drive shaft. The drive shaft is rotatably carried by a number of shaft support bearings 27 connected to the frame members F. In one specific embodiment, the shaft bearings 27 are Morse TRE-8T bearings available from Bearings, Inc. of Muncie, Ind.

A primary drive pack 30 provides rotary motion to the drive shaft 21, which imparts rotary motion to the shade roller 15 through the meshing of the driven gear 17 and the drive gear 23. It should be noted that the drive shaft 21 can be continuous from the first to the last window bay, while only one shade roller 15 and shade is provided for each individual window bay B.

A conveyor track assembly 32 is associated with each of the angled frame members A. At or adjacent to the junction between the angled member A and the vertical member V is a conveyor return idler assembly 34 (see FIGS. 1 and 9). The conveyor track assembly supports the window shade 10 as it is conveyed along the angle frame portion A. The conveyor assembly of the present invention is substantially concealed from view by way of a back cover 40 and a front cover 41 that completely house the shade roller and continuous drive shaft assembly 20. The primary drive pack 30 is enclosed within a housing 42. Side covers 43 are provided to cover the entire length of the frame F.

Figure 3:
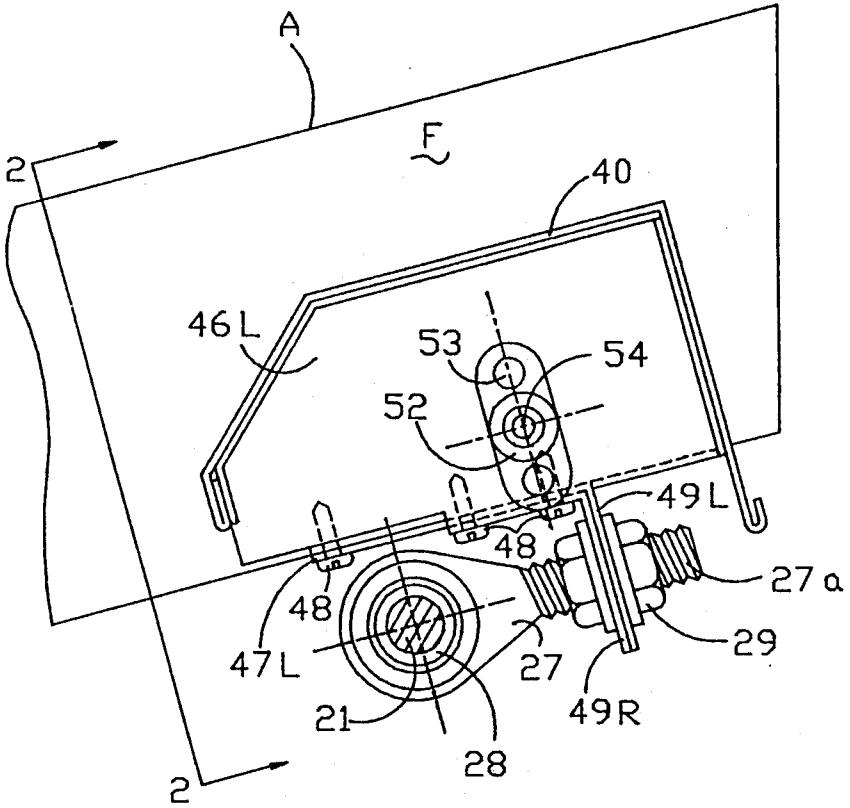
FIG. 3 is a side elevational view taken along line 3—3 in FIG. 2 as viewed in the direction of the arrows.
Figure 2:
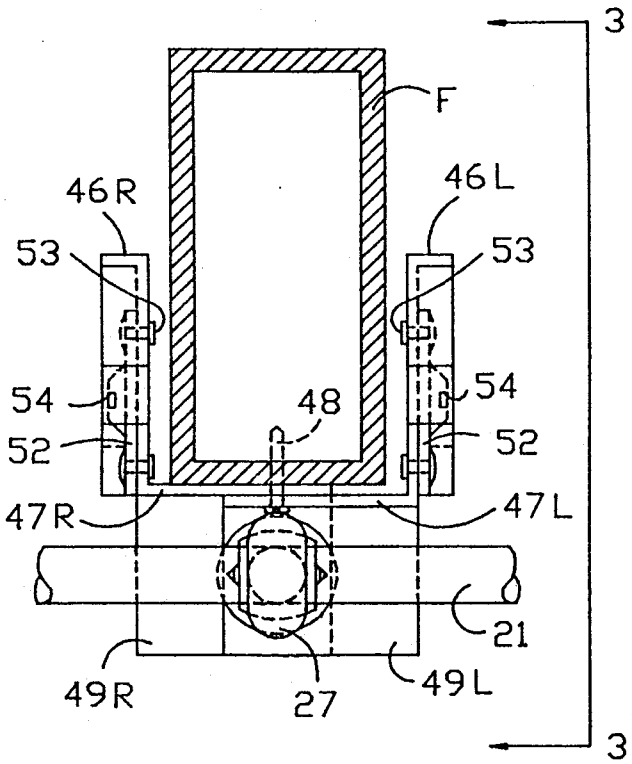
FIG. 2 is a top partial cross-sectional view of the encircled region designated with the numeral 2 in FIG. 1.

The specific details of the construction of the window shade conveyor assembly of the present invention are described with reference to FIGS. 2-13. In particular, FIGS. 2-3, FIGS. 5-6 and FIGS. 7-8 are similar views of the conveyor system in which specific components of the system are added between views to permit easier description and viewing of the entire system. In FIGS. 2 and 3, the manner in which shaft support bearings 27 are mounted to the frame F is illustrated. In particular, a left side end cap $46_L$ and right side end cap $46_R$ are attached to the frame member F. The left and right side end caps $46_L$ and $46_R$ are also shown in perspective views in FIGS. 4A and 4D.

For simplicity, only the components of the left side end cap $46_L$ are described since the right side components are a mirror image of the left side components. The end cap $46_L$ includes an attachment plate $47_L$ that abuts the forward face of the angled portion A of the frame F. A number of attachment screws 48 pass through slots in the attachment plate 47 and are threaded into the frame F. It can be seen from FIG. 2 that the attachment plates of the left and right portions $47_L$ and $47_R$, respectively, overlap and are both affixed to the frame by way of the attachment screws 48.

The end cap $46_L$ includes a perpendicular flange $49_L$ that projects outward from the attachment plate $47_L$. The flange $49_L$ includes a bearing post opening 50 for attachment of the shaft support bearing 27. The shaft support bearing 27 includes a threaded post portion 27*a* that extends through the bearing post opening 50. A pair of threaded nuts is provided in an adjustment assembly 29 to attach the threaded post portion 27*a* of the shaft bearing 27 to the two flanges $49_L$ and $49_R$.

Each of the end caps $46_L$ and $46_R$ include a shade roller bearing plate 52. The plate is affixed to the end cap $46_L$ by way of rivets 53. The plate includes a recess 54 into which a corresponding knob on the shade roller will fit. It can be seen from FIG. 3 that the back cover 40 is pressed over the end caps $46_L$ of $46_R$ at the opposite sides of a bay B so that the end caps provide support for the back cover 40 as it spans the width of the window bay B. (The back cover 40 has not been depicted in FIG. 2 to permit full viewing of all of the components).

Figure 6:
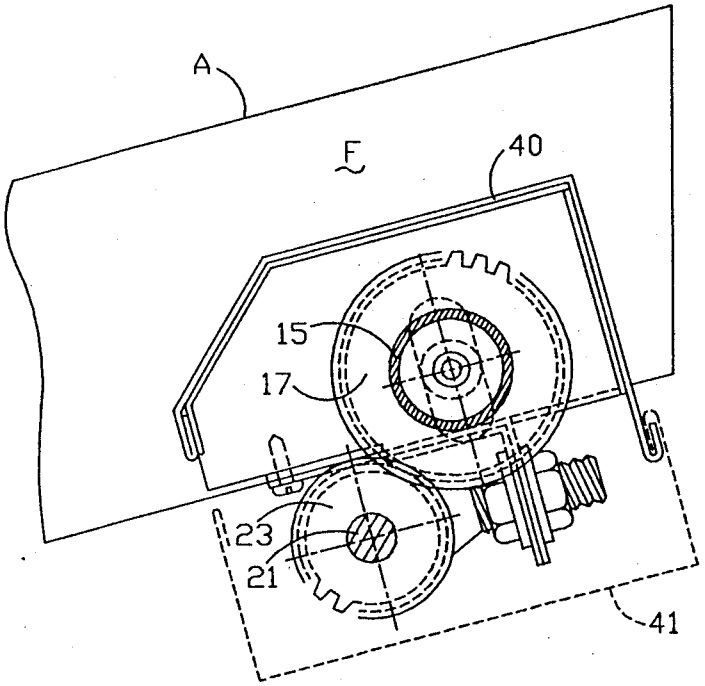
FIG. 6 is a side elevational view taken along line 6—6 in FIG. 5.
Figure 5:
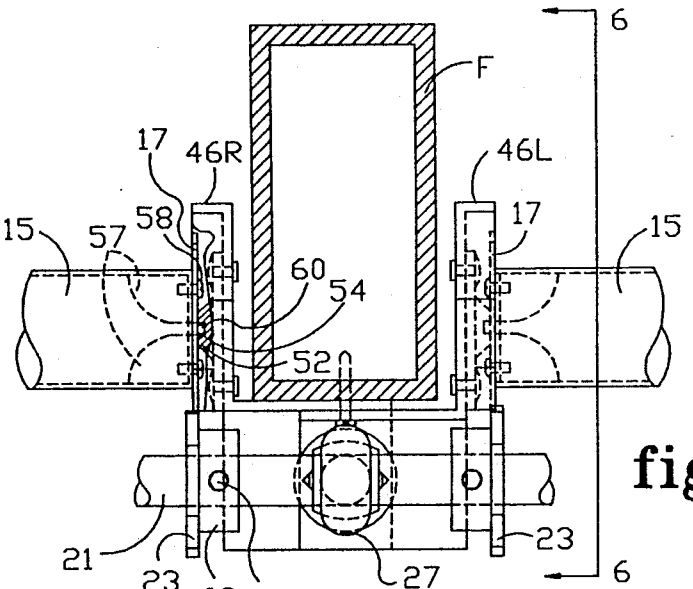
FIG. 5 is a top partial cross-sectional view similar to FIG. 2 in which additional components of the conveyor system have been added.
Figure 4B:
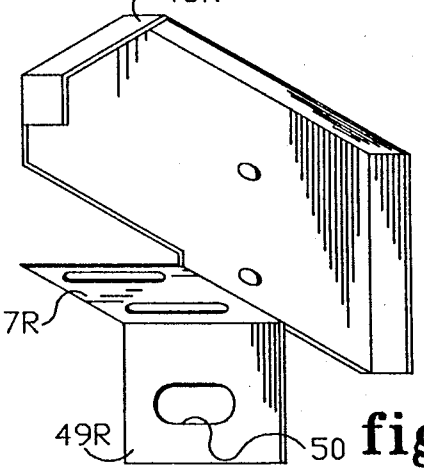
FIGS. 4A and 4B are perspective views of left and right side end cap components of the conveyor system of the present invention, which components are shown in FIG. 3.
Figure 4A:
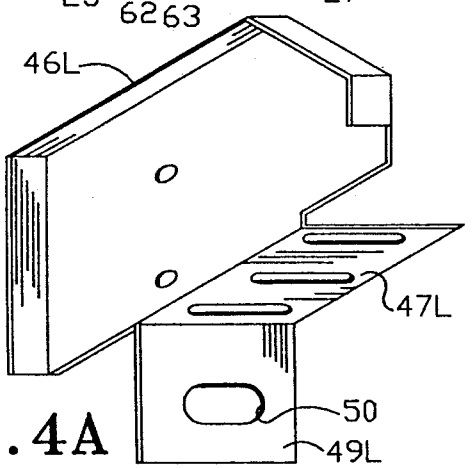

Referring now to FIGS. 5 and 6, additional components of the system have been added. In particular, each of the shade rollers 15 include a roller attachment portion 57. The attachment portion provides means for engagement with attachment screws 58. Each of the attachment screws 58 is used to affix the driven gear 17 to the end of the roller 15 so that both rotate together. The driven gear 17 includes an alignment knob 60 that fits within the recess 54 of the shade bearing plate 52. It is understood that the opposite end of the roller 15 also includes an alignment knob arrangement to act as a bearing for the roller. Only one end of the roller 15 requires the a driven gear 17, so the alignment knob 60 can be separately attached to the roller without the gear. Comparable bearing arrangements may be substituted for the alignment knob arrangement at one end of the roller.

The driven gear 17 meshes with a drive gear 23 as previously described. The drive gear 23 is integral with a drive gear collet 62, with the drive shaft 21 extending therethrough. A set screw 63 is used to fix the drive gear collet 62, and therefore the drive gear 23, to the drive shaft 21 so that both rotate in unison. It is understood that the drive gear 23 may also be keyed to the drive shaft in a typical fashion.

In the preferred embodiment, as shown in FIG. 6, the diameter of the drive gear 23 is considerably smaller than the outer diameter of the driven gear 17. Both gears have the same gear pitch so that the larger gear 17 has a greater number of gear teeth than the smaller drive gear 23. Consequently, the rotational speed of the drive gear 23 will always be greater than the rotational speed of the driven gear 17. This feature is important to the operation of the window shade conveyor system of the present invention so that the window shade roller 15 does not overspeed relative to the drive shaft 21 and the associated conveyor belt to be described herein.

Figure 8:
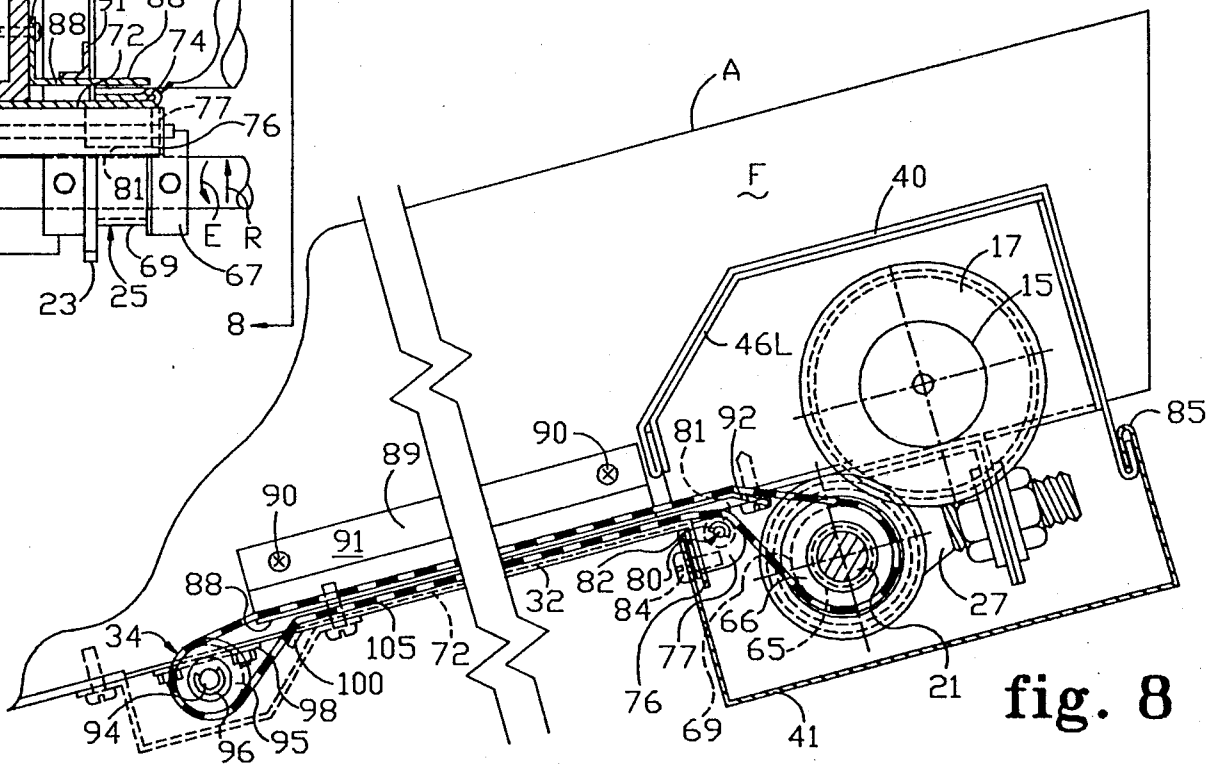
FIG. 8 is a side elevational view taken along line 8—8 in FIG. 7.
Figure 7:
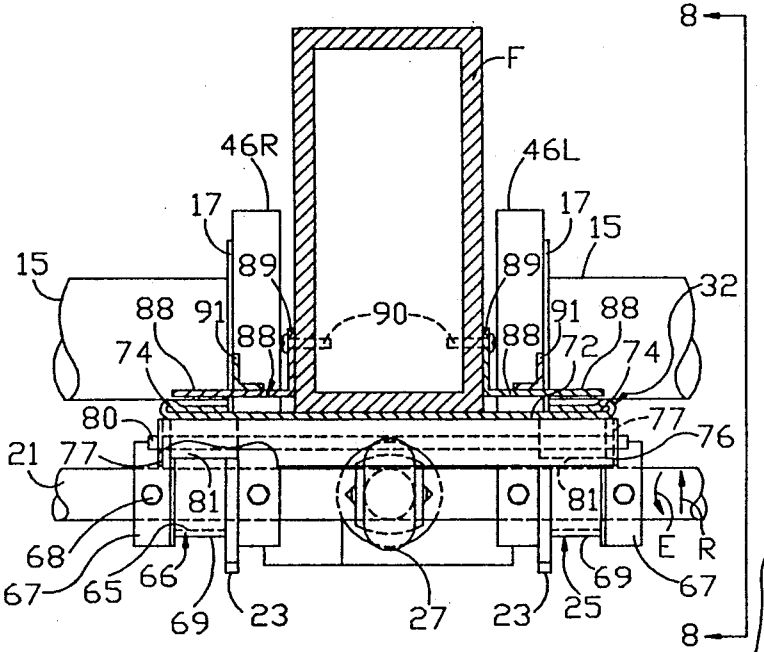
FIG. 7 is a top partial cross-sectional view similar to FIG. 5 with additional components of the system added.

FIGS. 7 and 8 illustrate the assembly with additional components added. In particular, the components of the shaft clutch 25 are illustrated. The shaft clutch 25 includes a roller clutch 65 that is adjacent the drive shaft 21. A roller clutch spool 66 is engaged circumferentially about the roller clutch 65. A collar 67 mounted to the drive shaft 21 by way of a set screw 68 retains the shaft clutch 25 between the drive gear 23 and the collar 67. In the preferred embodiment, the shaft clutch 25 is a Torrington drawn cup roller clutch which transmits torque between the shaft 21 and the spool 66 in one direction only and allows free overrun in the opposite direction. That is, when the shaft 21 is rotating in the extension direction E (to unwind the window shade), the roller clutch spool 66 will also rotate in that direction. However, when the drive shaft 21 is rotated in the opposite retraction direction R (to wind or retract the shade), the spool 66 will not rotate with the drive shaft 21 and clutch 65. In one specific embodiment, a Torrington roller clutch designated as a RCB-081214 is used. The clutch spool 66 includes a conveyor belt drive surface 69, which is, in essence, the outer face of the spool 66.

The conveyor track assembly 32, previously shown in FIG. 1, includes a conveyor track plate 72, as shown in FIG. 7 and 8. The conveyor track plate 72 is also shown in more detail in FIG. 9. The track plate 72 is affixed to each of the angled five frame members A shown in FIG. 1. The side edges of the plate 72 are folded over to form side channels 74. The track plate 72 also includes a forward flange 76 that projects perpendicularly downward from the track plate 72.

A pair of side brackets 77 also extend perpendicularly from the forward flange 76. An upper idler shaft 80 extends between the two side brackets 77, and particularly through openings through the brackets. A pair of idler spools 81 are fixed to the idler shaft 80 inside the bracket 77. The idler shaft 80 is retained by a pair of retaining washers 82 at its opposite ends outside the bracket 77. As shown in FIG. 8, the upper idler shaft 80 and idler spools 81 are mounted so that they are displaced from the face of the angled frame member A.

As shown more clearly in FIG. 8, the front cover 41 is attached to cover the remainder of the drive shaft assembly and upper idler shaft assembly. The front cover 41 engages with the back cover 40 by way of a mechanical hinge 85 formed by bends in the cover material. The other side of the front cover 41 is attached to the forward flange 76 by way of attachment screws 84.

The window shade conveyor system of the present invention further includes an inner guide track 88 that is mounted to the sides of the frame member F by way of screws 90 passing through a mounting flange 89 to the frame member F. The guide track 88 is affixed at right angles to the mounting flange, projecting perpendicularly from the side of the frame member F. A side track flange 91 is affixed to the guide track 88, preferably by welding, approximately mid-length along the track. Thus, the portion of the inner guide track 88 outboard of the side track flange 91 is provided to guide the conveyor belt, as described in more detail below. At the upper end of the guide track 88 is an upper belt guide 92 which is bent at an angle to the guide track 88, as shown in FIG. 8.

Figure 9:
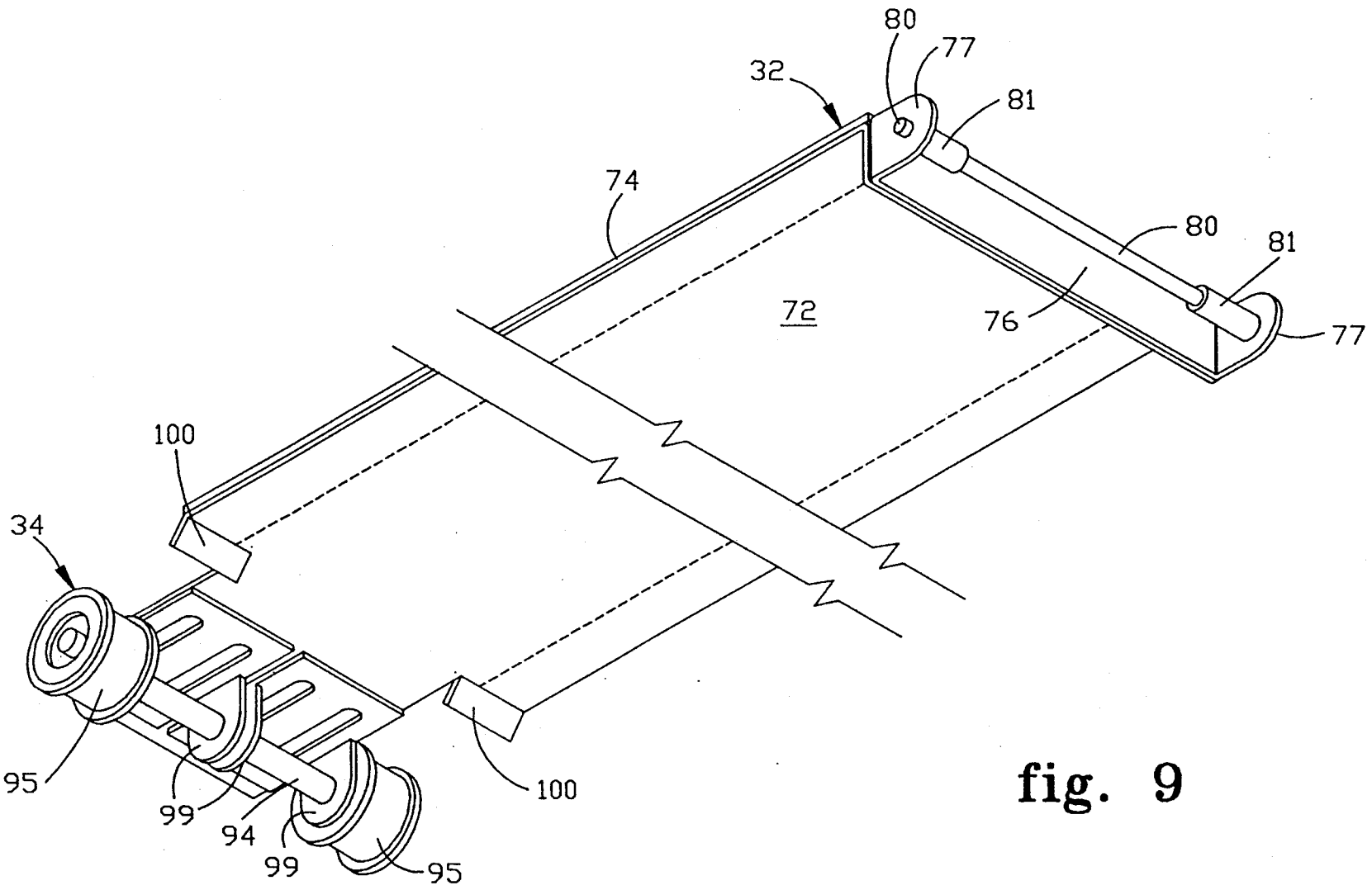
FIG. 9 is a bottom perspective view of a conveyor track plate that is used as part of the window shade conveyor system of the present invention shown in FIG. 8.

With reference to FIGS. 8 and 9, it can be seen that the conveyor return idler assembly 34 includes a lower idler shaft 94 onto which idler spools 95 are fixed at the opposite ends of the shaft by retaining washers 96. The idler shaft 94 passes through a number of support brackets 99. The support brackets 99 are part of a mounting plate 98 which is affixed to the conveyor track plate 72. The mounting plate 98 also provides means for mounting one end of the track plate 72 to the frame member F. It can also be seen in FIGS. 8 and 9 that the lower end of the conveyor track plate 72 is bent to form a lower belt guide 100 to provide a smooth surface for the conveyor belt to pass over.

As shown in FIG. 8, a continuous conveyor belt 105 is engaged about the drive surface 69 of the roller clutch spool 66. The upper portion of the belt passes over the upper belt guide 92 portion of the inner guide track 88. The belt continues to pass over the inner guide track 88 between the edge of the track and the side track flange 91. The side track flange 91 keeps the conveyor belt 105 aligned with the clutch spool 66. The belt continues to pass over the top of the inner guide track 88 until it reaches the end of the track at which point it loops over the lower idler spool 85 of the return idler assembly 34. The belt passes around the lower spool 95 and is directed by the lower belt guide 100 to the top surface of the conveyor track plate 72. As the belt passes along the top surface of the conveyor track plate 72, the folded side channel 74 keeps the belt from slipping outside the track plate. When the belt approaches the roller clutch spool 66, it loops over an upper idler spool 81.

The conveyor belt 105 is a continuous belt, preferably ½" wide. The belt is preferably constructed of neoprene and cotton duck. The neoprene provides an adequate gripping surface to pull the window shade along with the belt. The cotton duck material provides belt strength and helps reduce the friction as the belt moves across the conveyor track plate 72 and the inner guide track 88.

Figure 10:
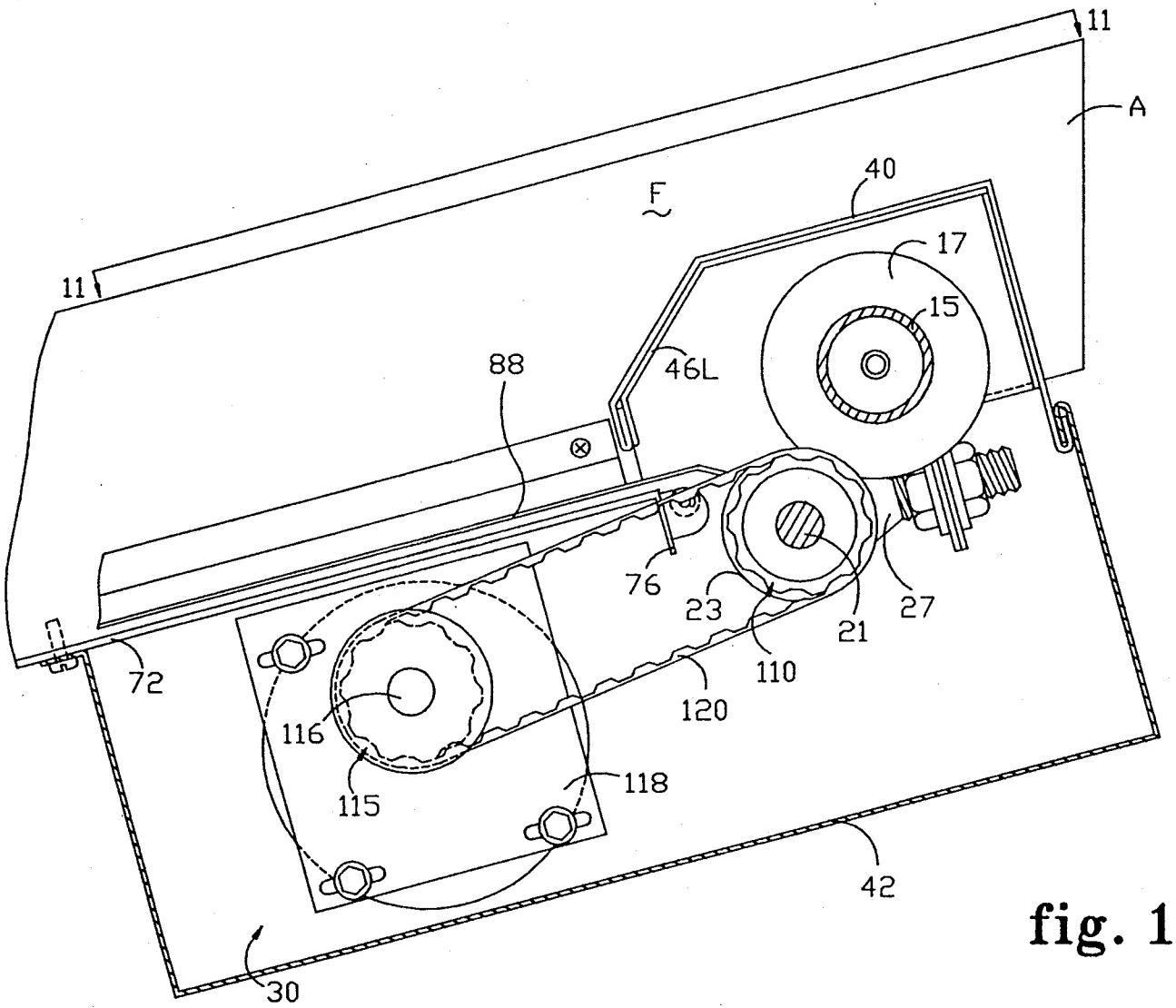
FIG. 10 is a side elevational view of the primary drive system of the conveyor system of the present invention.
Figure 11:
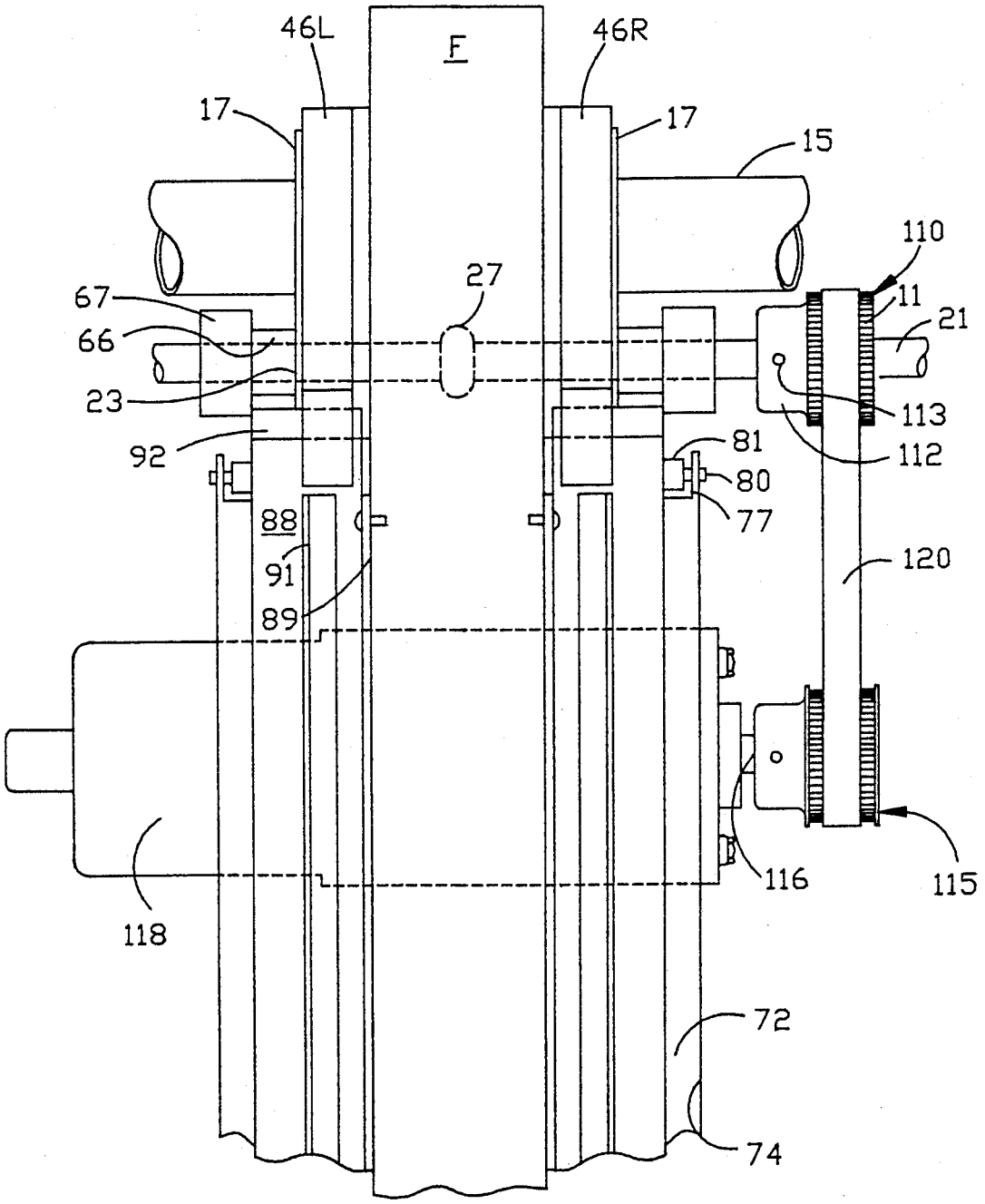
FIG. 11 is a top view of the primary drive system taken along line 11—11 as viewed in the direction of the arrows in FIG. 10.

The primary drive system 30 is illustrated in FIGS. 10 and 11. The primary drive system 30 includes a driven sprocket 110 that is engaged to the drive shaft 21. The driven sprocket 110 includes a gear 111 integral with a collet 112. The collet is engaged to the drive shaft 21 by way of a set screw 113. The collet 112 may also be keyed to the drive shaft in a conventional fashion. A drive pulley 115 is affixed to a motor drive shaft 116 of a conventional gear motor 118. In the preferred embodiment, the gear motor has an output speed range of 50–150 r.p.m. The motor is separately attached to the frame F or the conveyor track plate 72. A drive belt 120 spans between the gear 111 and the drive pulley 115. Thus, rotary operation of the motor 118 transmits rotary motion from the drive pulley 115 to the driven sprocket 110 and ultimately to the drive shaft 21. The rotation of the drive shaft 21 is continuous throughout its length and provides for rotary motion for each of the individual drive gear 23 and driven gears 17.

Figure 12:
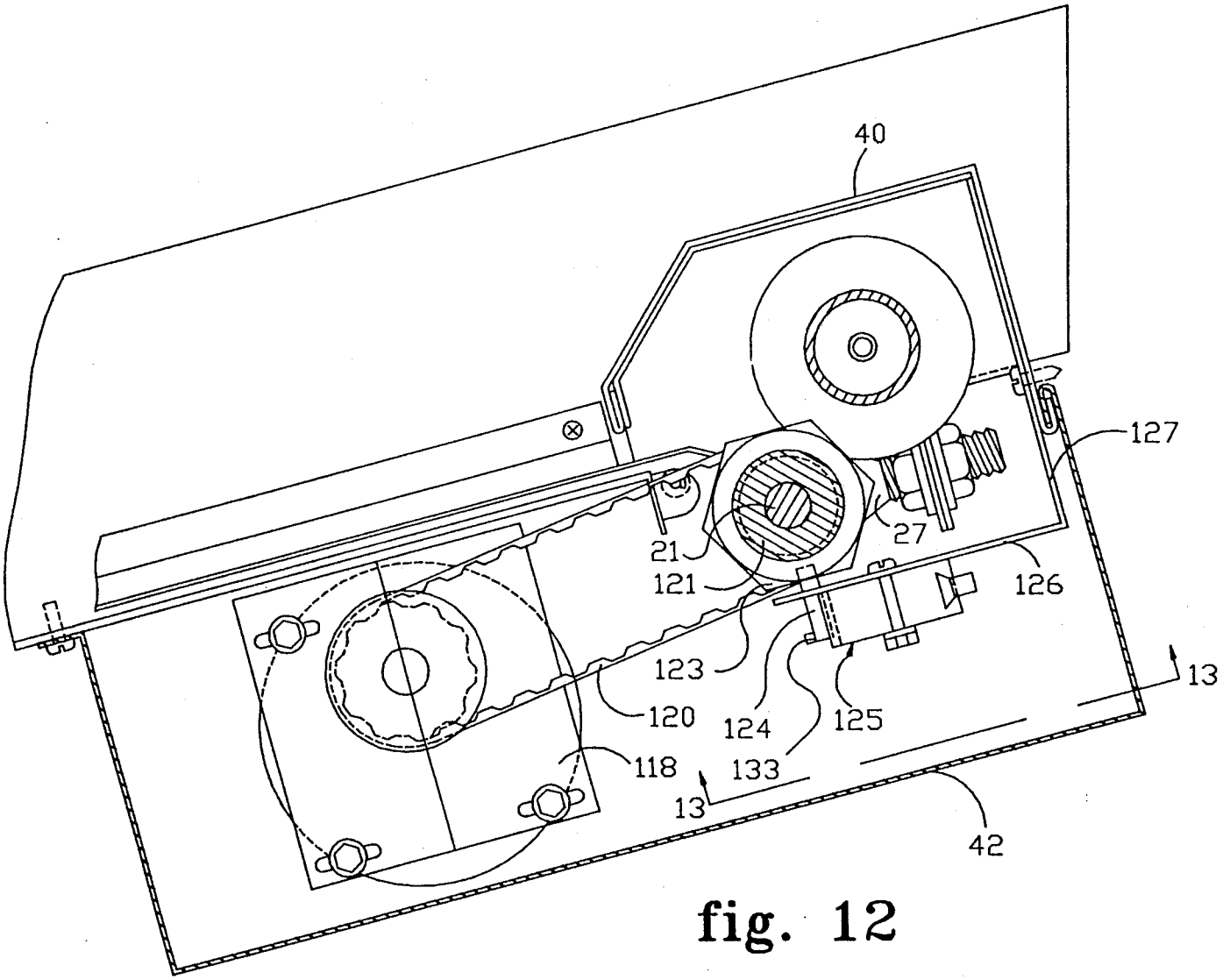
FIG. 12 is a side elevational view of the limit switch arrangement for the window shade conveyor system of the present invention.
Figure 13:
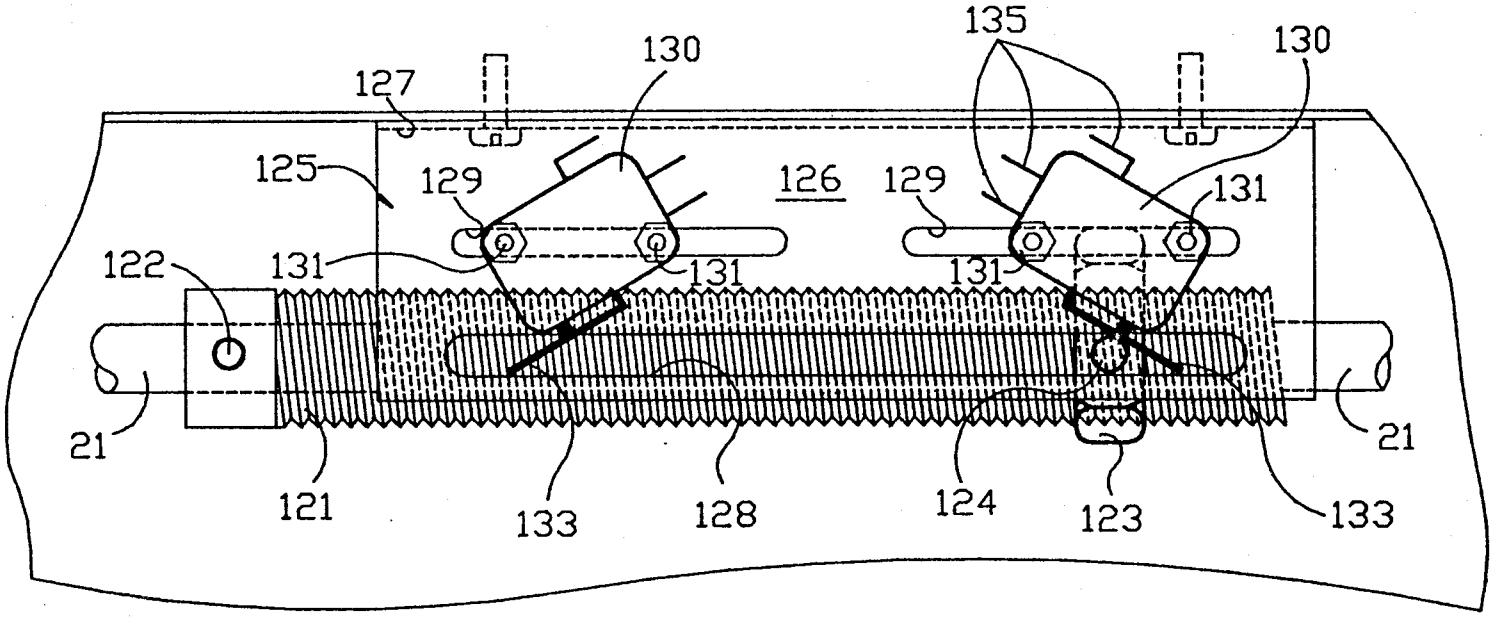
FIG. 13 is a bottom view of the limit switch arrangement taken along line 13—13 in FIG. 12 as viewed in the direction of the arrows.

The operation of the motor 118 is controlled by way of a limit switch assembly as shown in FIGS. 12 and 13. A lead screw 121 is engaged to the drive shaft 21 by way of a set screw 122. The lead screw may also be welded or affixed in some other manner to the drive shaft 21. A hex nut 123 is threaded onto the lead screw 121 and is free to travel up and down the lead screw 121 as the screw is rotated. A contact pin 124 is affixed to one side face of the hex nut 123, such as by welding or other suitable means.

A limit switch assembly 125 is provided which includes a switch plate 126. The switch plate 126 is affixed to the back cover 40 by way of an attachment flange 127. Mounting the switch plate 126 to the back cover 40 permits ready adjustment of the assembly 125 by simply removing the front cover 41 and drive pack cover 42. The switch plate 126 includes a pin slot 128 which extends substantially along the entire length of the plate adjacent the free edge of the plate 126. The pin slot 128 generally spans the length of the lead screw 121. The contact pin 124 extends through the pin slot 128 so that the pin is free to travel along the length of the slot. In addition, the pin slot 128 prevents the hex nut 123 from rotating as the lead screw 121 rotates with the drive shaft 21. As the drive shaft 21 rotates, the hex nut translates along the lead screw 121.

The switch plate further includes a pair of switch location slots 129. A pair of limit switches 130 are provided that are connected to the switch plate by attachment bolts 131 extending through a respective location slot 129. The slots are long enough to permit adjustment of the locations of the limit switches 130. Each of the limit switches includes a switch contact 133 which is disposed directly over the pin slot 128. A number of output leads 135 are provided on the limit switches 130, which output leads can be fed directly to an on/off controller for the motor 118.

In the operation of the limit switch assembly, as the contact pin 124 mounted to the hex nut 123 contacts one of the switch contacts 133, it indicates that the hex nut 123 is at one end of its travel. The travel of the hex nut can be correlated to the amount that the window shade 10 has been unwound from or wound onto the shade roller 15. That is, when the window shade has been completely rewound onto the roller 15, the hex nut 123 is situated at one end of its travel in contact with the switch contact 123 of one of the limit switches 130. When the window shade 10 has been completely unrolled and is entirely covering the window, the hex nut 123 is at the opposite end of its travel and contacts the 3witch contact 133 of the other limit switch 130. The signal from the output leads of each of the limit switches 130 can be provided to an on/off switch that is user controlled so that when the unit is turned on to extend or retract the shade, the limit switches operate to make sure that the system shuts off at the appropriate points.

Figure 14:
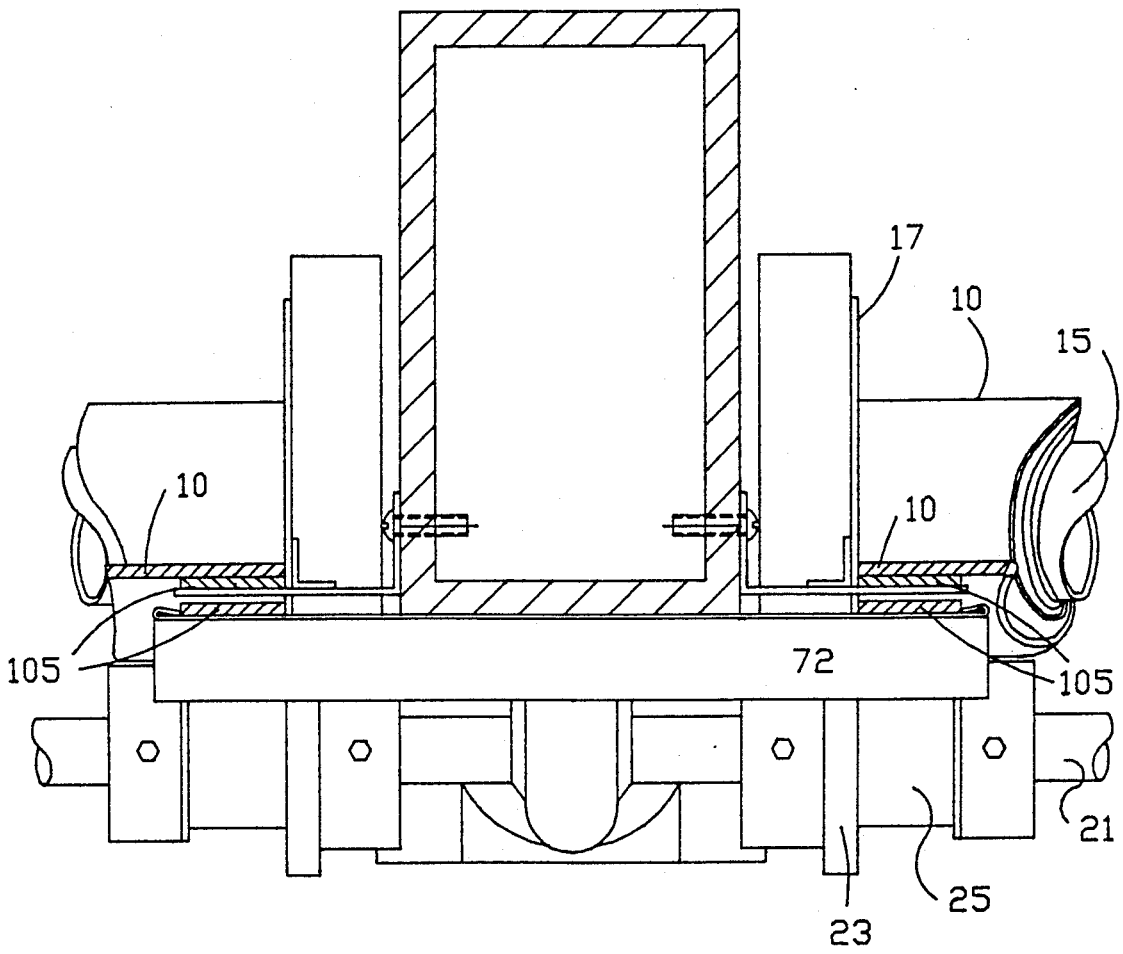
FIG. 14 is a top partial cross-sectional view similar to FIG. 7 with hidden lines removed, showing the operation of the window shade conveyor system of the present invention in which a window shade is shown partially drawn along the conveyor of the present system.
Figure 15A:
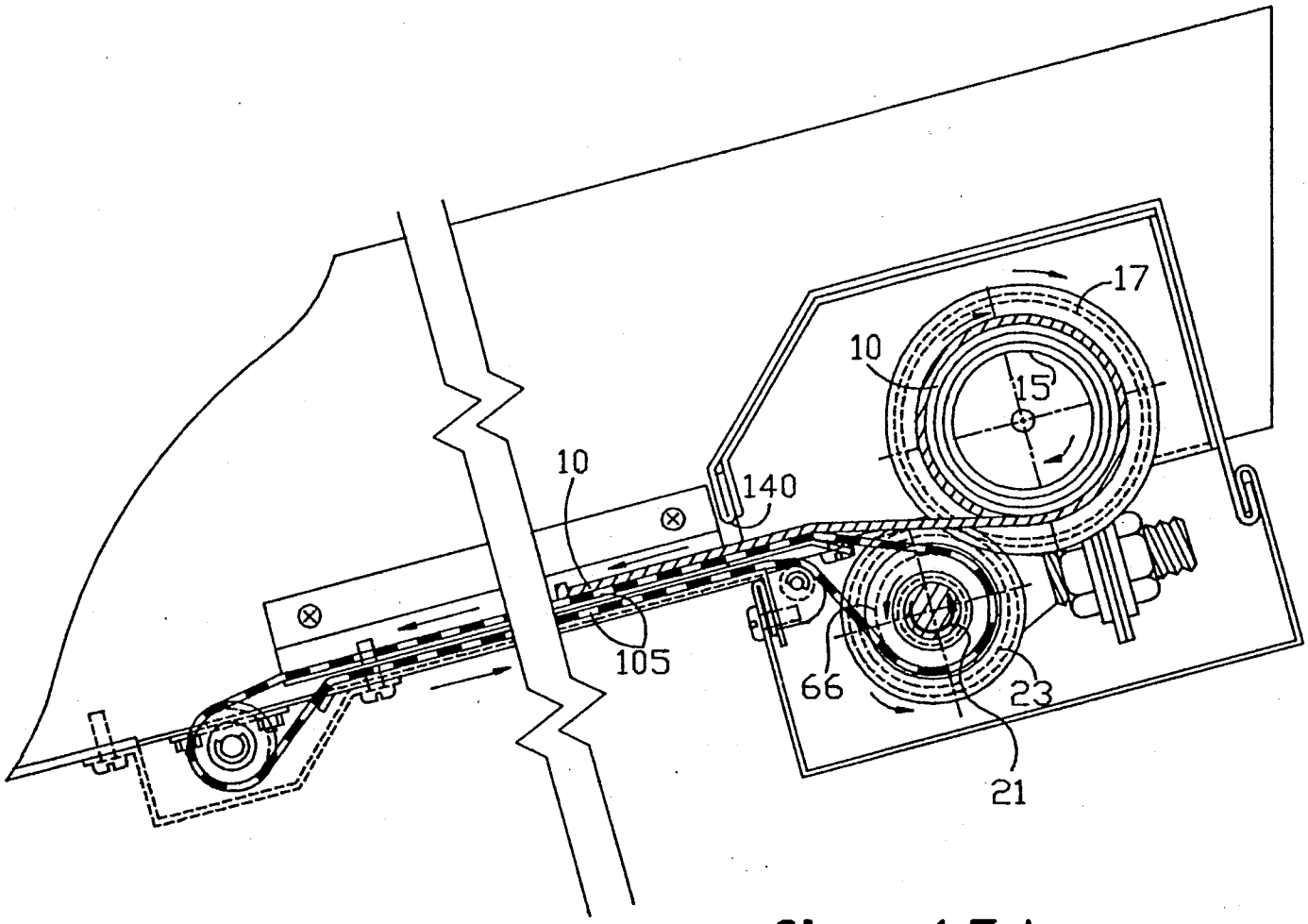
FIG. 15A is a side elevational view similar to the view in FIG. 8 showing the window shade conveyor system in one phase of its operation in which a window shade is partially conveyed along the conveyor of the present invention.

The operation of the window shade conveyor system of the present invention is shown with reference to FIGS. 14 and 15A–15C. In FIG. 14, it is seen that the shade 10 is wound onto the roller 15. The shade 10 is fed through an opening 140 between the back cover 40 and the front cover 41. This opening 140 extends along the entire lateral length of the two covers between the frame members A in window bay B. The window shade 10 is situted on top of the conveyor belt 105 as shown in FIGS. 14 and 15A. Thus, the conveyor belt supports the side edges of the window shade at each of the frame members A. The addition of horizontal stays 11 to the window shade 10 provides adequate strength to the window shade so that it does not sag or droop when it is supported at its edges in the manner described.

When the primary drive motor 18 is activated, it rotates the drive shaft 21 by way of the drive pulley 115 and drive sprocket 110. The rotation of the drive shaft 21 causes the drive gear 23 to rotate in the counterclockwise direction. The driven gear 17 also rotates since it is direct mesh with drive gear 23. It is apparent that the drive gear 23 and driven gear 17 rotate in opposite directions. The clockwise rotation of the driven gear 17 causes the shade roller 15 to also rotate in the same direction. When the drive shaft 21 rotates in the counter-clockwise direction as shown in FIG. 15A, the shade 10 unwinds from the shade roller 15. Thus, the shade 10 travels linearly in the direction indicated by the arrow directly above the shade in FIG. 15A.

Counterclockwise rotation of the drive shaft 21 also means counterclockwise rotation of the shaft clutch 25. The shaft clutch 25 transmits torque from the drive shaft 21 to the roller clutch spool 66, as previously described, when the clutch 65 rotates in the counterclockwise direction. Rotation of the roller clutch spool 66 causes the conveyor belt 105 to also move since the belt is looped around the conveyor belt drive surface 69. The belt moves linearly in the direction indicated by the two arrows—that is the upper surface of the belt moves in the direction that the window shade 10 is being payed out, while the lower portion of the belt moves in the opposite direction during its return travel.

As previously discussed, the rotational speed of the drive gear 23 is greater than that of the driven gear 17. Likewise, the rotational speed of the roller clutch spool 66 is also greater than the speed of the driven gear 17 and the shade roller 15. Thus, the linear speed of the conveyor belt 105 is faster than the fastest speed at which the window shade 10 is being unrolled from the roller 15. This particular feature insures that the window shade will be payed out from the roller 15 faster than the conveyor belt is traveling which, if allowed to occur, would cause the window shade to bunch up along the conveyor belt.

Figure 15B:
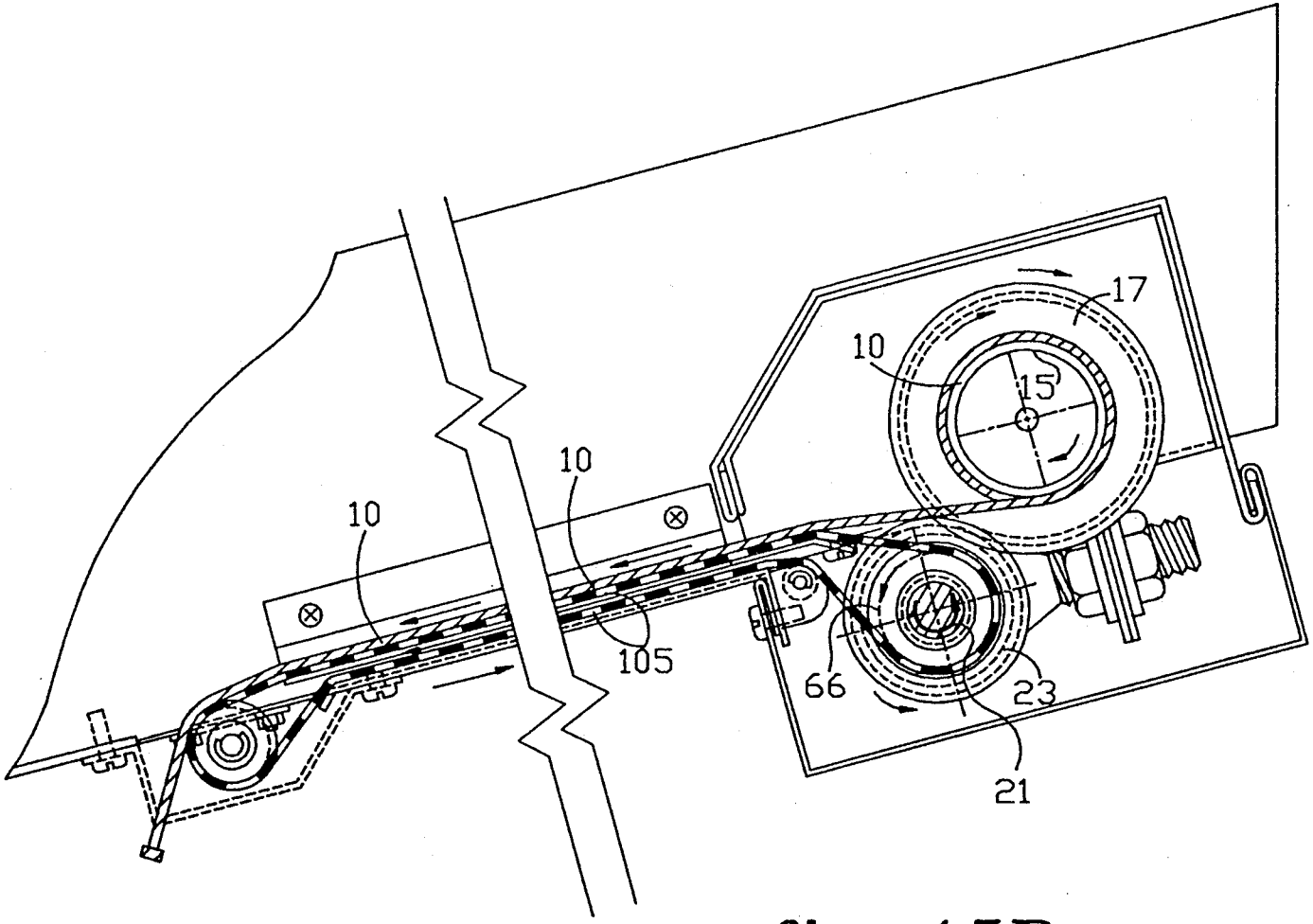
FIG. 15B is a side elevational view similar to the view in FIG. 15B in which the window shade has been conveyed further along the conveyor system.

As the motor continues to operate, the window shade 10 is drawn further along the conveyor belt 105, until it reaches the position shown in FIG.15B. At this point, the window shade 10 has traveled beyond the end of the conveyor assembly and is permitted to fall by force of gravity. Preferably, the end of the conveyor system, and more specifically the conveyor return idler assembly 34, is immediately adjacent to the interface between the angled portion A and the vertical portion V of the frame F. At this point, the window shade 10 is immediately adjacent the vertical window panes so that there is no need for it to be guided by the conveyor assembly of the present invention. In addition, the force of gravity will tend to assist the travel of the window shade 10 over the moving conveyor belt 105 and help eliminate any wrinkling or bunching of the window shade 10.

As previously indicated, an important feature of the invention concerns the relationship of the conveyor belt speed to the speed of the window shade as it is payed out from the shade roller 15. Maintaining the belt speed faster than the shade linear rate requires the proper relationship between the rotational speeds (RPM) and the outer diameters of the roller 15 and the clutch spool 66, or more particularly the conveyor drive surface 69 of the clutch spool. Since the linear rate of the window shade will change as it unrolls from the roller, the relationship must be established so that the highest linear rate of the shade as it unrolls is slower than the linear rate of conveyor belt 105 driven by the clutch spool 66.

Figure 15C:
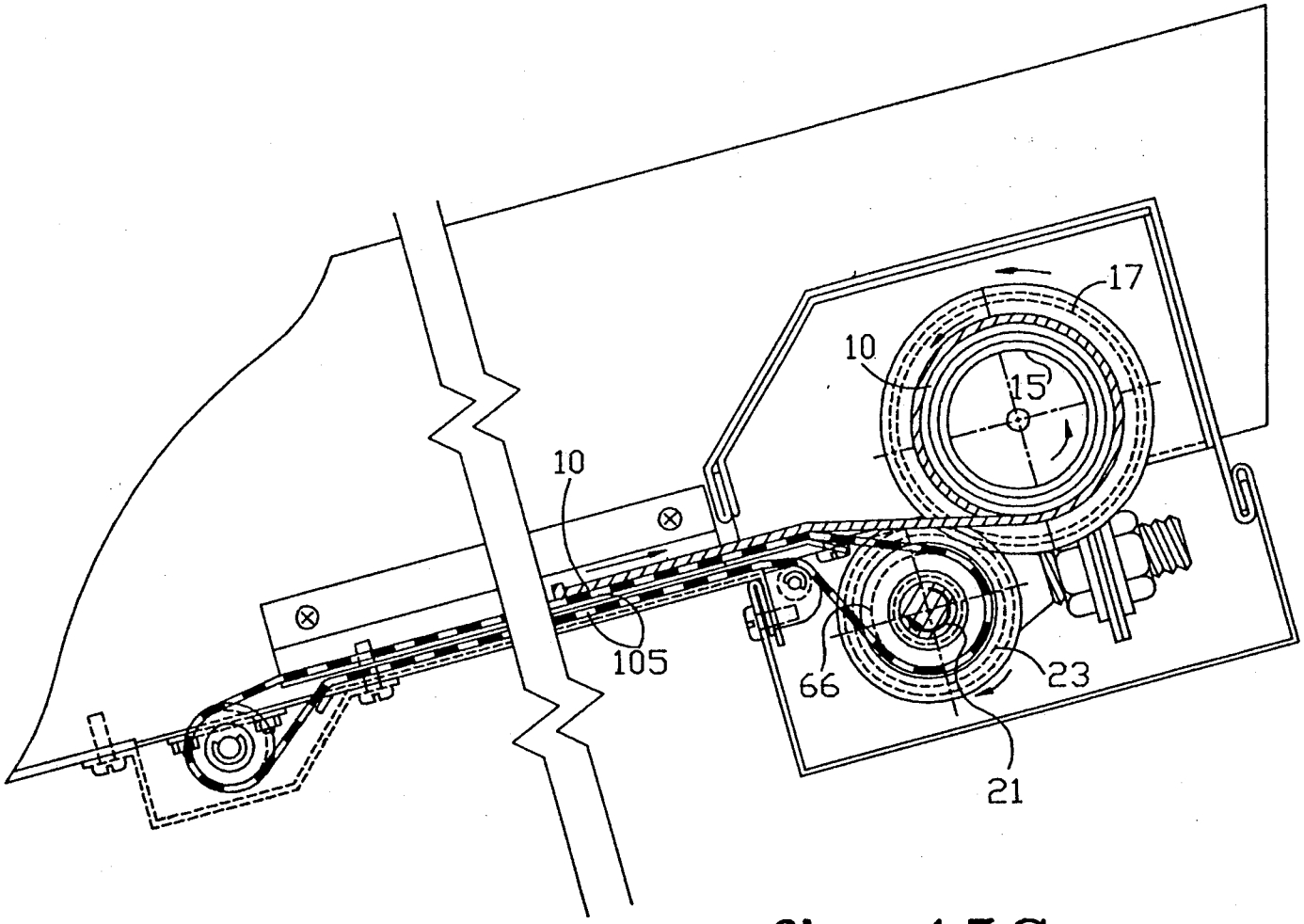
FIG. 15C is a side elevational view similar to the view in FIG. 15A in which the window shade is shown being retracted.

FIG. 15C illustrates the return cycle of the operation of the present invention. When it is time to return the shade to the shade roller 15, that is, raise the shade, the motor 118 is driven in the opposite direction. In this instance, as shown in FIG. 15C, the drive shaft 21 is now driven in the clockwise direction. Clockwise motion of the drive gear 21 causes the driven gear 17 and ultimately the shade roller 15 to rotate in the counterclockwise direction. In this direction, the window shade 10 is pulled onto the shade roller 15 and thereby retracted.

When the drive shaft 21 rotates in the clockwise direction, the shaft clutch 25 does not transmit torque or rotational motion to the roller clutch spool 66. Thus, the conveyor belt 105 is not driven in relation to the clockwise rotation of the drive shaft 21. (However, the belt may move as the shade is dragged over the surface of the belt). The shade roller 15 provides the entire motive force for retracting the window shade 10, as the shade moves in the direction indicated by the arrow in FIG. 15C. Bunching of the shade is not a problem since the inertia of the shade, along the friction of moving across the conveyor belt 105, will tend to keep the window shade 10 flat as it is retracted. It is understood that if the conveyor belt 105 were allowed to continue moving, it would cause the window shade 10 to bunch up as it is retracted since the conveyor belt 105 moves at a faster speed than the window shade.

In the preferred embodiment, most of the moving components of the invention are formed from steel or aluminum. For example, the drive shaft 21 is formed from cold-drawn 1010 or 1018 shaft grade steel. The driven gear 17 and drive gear 23 are formed from steel having a 0.25 inch face width. The collars 62 and 67 are also preferably steel. The end caps $46_L$ and $46_R$ can be formed of steel, in this instance, 18 gauge steel.

On the other hand, the back cover 40, front cover 41, drive pack cover 42 and side cover 43 are composed of 60–63 T5 extruded aluminum with a 0.060 wall thickness. The conveyor track plate 72 and inner guide track 88 are also formed of the same aluminum. It is understood, however, that these components may also be formed of a steel, such as stainless steel.

The bearings included within the shaft support bearings 27 are preferably self-aligning bearings and permanently lubricated with a TEFLON®. The spools 81 and 95 may be composed of PVC or steel, or other similar durable material.

The electric motor 118 is a typical 115 volts, 60 hz. AC gear motor with a horsepower of 1/20, 1/12 or ⅛, depending upon the amount of power required. The amount of power required is typical determined by the length of the window shades and the number of window bays driven off a single drive shaft. The limit switches 130 are typical micro switches, sold as UL listed numbers E23301-CSA approved 16503.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

For instance, it is understood that the motor 118 can be a DC motor, rather than a AC motor, provided that adequate horsepower can be obtained. Moreover, the DC motor can be replaced by a manual crank. In the manual version, the drive pulley 115 and driven sprocket 110 can be replaced by a pair of 0.18"face width steel beveled gears, in a standard ratio of 1:1. An optional ratio of 1.2 can be provided for added capacity, again depending upon the necessary horsepower.

It is also understood that the drive shaft 21 need not be a single continuous shaft or bar. The shaft 21 can include individual shaft members that have male and female threaded ends. Male and female ends can then be engaged to form single length of shaft.

In addition, the conveyor return idler assembly 34 may be located at the bottom or base of the window frame assembly. In this configuration, the conveyor track assembly would negotiate the entire length of the vertical frame members V in the illustrated atrium-type window structure. The shade conveyor system of the present invention is equally usable with slanted window bays or with flat skylight treatments in which the windows are essentially horizontal.

Moreover, the drive gear 23 and driven gear 17 can be replaced by another direct drive arrangement. For instance, a worm gear or bevel gear arrangement may be used to transmit rotary motion from the drive shaft 21 to the shade roller 15. Likewise, a pair of contacting friction rollers may also be used.

In another modification, the motor 118 is replaced by a SOMFI drive system in which a motor is contained within one of the rollers 15. In this instance, the drive gear 17 of one of the rollers becomes the primary drive for the entire system. The drive gear 23 then becomes the driven gear at that particular roller. For the remaining window bays the drive gear 23 and driven gear 17 operate in the same manner.

What is claimed is:

1. A window shade conveyor system for use with a window assembly having parallel frame members supporting a window pane therebetween, the frame members being non-vertically oriented, said conveyor system comprising:

a shade roller rotatably supported between the frame members at an upper portion of the frame members, the roller carrying a window shade wound thereon, said window shade having a first end connected to said shade roller, an opposite second free end, and opposing lateral free edges, said roller being rotatable in a rotary first direction so that the shade is unwound therefrom in a linear second direction to cover the window pane between frame members a conveyor assembly mounted to each of the frame members, each said conveyor assembly including; a rotatable driving member;

an idler supported by said frame member at a portion distal said driving member;

a continuous conveyor belt mounted between said driving member and said idler to form a continuous loop, whereby rotation of said driving member causes said conveyor belt to move linearly around said continuous loop, said conveyor belt having a shade supporting surface;

wherein one of said lateral edges of said window shade is supported by said conveyor belt at said shade supporting surface when said shade is unwound from said roller; and first rotary means for rotating said driving member so that said conveyor belt moves linearly in said second direction when said window shade is being unwound from said shade roller.

2. The window shade conveyor system of claim 1, wherein:

said first rotary means for rotating includes a drive shaft;

said driving member includes a one-way clutch mounted on said drive shaft;

said shade roller second rotary means for engaging said drive shaft for transmitting rotary motion therebetween; and power means for rotating said drive shaft in one direction corresponding to unwinding said shade from said roller and in the opposite direction corresponding to winding said shade onto said roller;

wherein said one-way clutch is operable to move said conveyor belt only when said drive shaft is rotating in said one direction.

3. The window shade conveyor system of claim 2, wherein:

said power means includes an electric motor.

4. The window shade conveyor system of claim 1, further comprises:

second rotary means for rotating said shade roller and for maintaining a speed relationship between the rotary speed of said roller and the rotary speed of said driving member such that said driving member causes said conveyor belt to move in said second direction at a linear speed faster than the fastest linear speed at which said window shade moves in said second direction.

5. The window shade conveyor systems of claim 4, wherein:

said first rotary means includes a drive shaft;

said driving member is engaged on said drive shaft and has an outer circumferential surface onto which said conveyor belt is engaged;

said second rotary means includes;

a driving gear engaged on said drive shaft; and a driven gear connected to said shade roller and in meshed engagement with said driving gear;

wherein the outer diameter of said circumferential surface of said driving member is smaller than the outer diameter of said shade roller.

6. The window shade conveyor system of claim 1, further comprising;

a motor;

a drive shaft rotatably coupled to said motor, said first rotary means including said drive shaft;

second rotary means between said drive shaft and said shade roller for rotating said shade roller;

switch means for shutting said motor off when said window shade has been fully unwound from or fully wound onto said roller, said switch means including;

a lead screw engaged to said drive shaft;

a nut threadedly engaged about said lead screw;

a contact pin affixed to and extending outward from said nut in a direction perpendicular to the longitudinal length of said lead screw;

means for restraining said nut from rotating with said lead screw while permitting said nut to move along said lead screw as said lead screw; at least one limit switch supported adjacent said lead screw and having a switch contact arranged for contact by said contact pin as said nut moves, said limit switch further having means for transmitting a signal to said motor when said contact pin engages said switch contact; and means for shutting said motor off in response to said signal from said limit switch.

7. The window shade conveyor system of claim 1, wherein each said conveyor assembly includes:

a guide track mounted to a frame member, said guide track having a flange projecting generally perpendicularly from the frame member, said flange extending through said continuous conveyor belt loop to support at least a portion of said conveyor belt.

8. A window shade conveyor system for use with multiple window bays having a number of parallel frame members supporting a number of window panes therebetween, each of said frame members being non non-vertically oriented, said conveyor system comprising:

a number of shade rollers, one each of said number of rollers being rotatably supported between a pair of frame members at an upper portion thereof, and each of said number of rollers carrying a window shade wound thereon and adapted to be unwound to cover a window pane between the frame members , said window shade having a first end connected to said shade roller, a second opposite free end, and opposite lateral free edges;

a drive shaft oriented perpendicularly to the frame members and extending continuously between the endmost frame members;

a number of shaft bearings mounted one each to a frame member adjacent said roller, said drive shaft rotatably extending therethrough;

power means for rotating said drive shaft;

rotary means between said drive shaft and each of said number of shade rollers for transmitting rotary motion therebetween;

a number of conveyor assemblies, one each of said number of conveyor assemblies being mounted to one of the frame members, each of said number of conveyor assembly including a rotatable driving member engaged with said drive shaft;

an idler distal supported by said frame member at a piston distal said driving member;

a continuous conveyor belt mounted between said driving member and said idler to form a continuous loop, whereby rotation of said driving member causes said conveyor belt to move linearly around said continuous loop, said conveyor belt having a shade supporting surface;

wherein, each said window shade carried by one of said number of rollers is supported at its lateral edges by said shade support surface of said conveyor belt.

9. The window shade conveyor system of claim 8, wherein:

said driving member includes a one-way clutch;

said rotary means includes;

a driving gear engaged on said drive shaft; and a driven gear connected to said shade roller and in meshed engagement with said driving gear;

wherein said one-way clutch is operable to move said conveyor belt only when said drive shaft is rotating in a first direction related to the direction of rotation of said roller when said window shade is unwound therefrom.

10. The window shade conveyor systems of claim 8, wherein:

said driving member has an outer circumferential surface onto which said conveyor belt is engaged;

said rotary means includes;

a driving gear engaged on said drive shaft; and a driven gear connected to said shade roller and in meshed engagement with said driving gear;

wherein the outer diameter of said circumferential surface of said driving member is smaller than the outer diameter of said shade roller.

11. The window shade conveyor system of claim 10, wherein:

said power means includes a motor; and said conveyor system further comprises;

switch means for shutting said motor off when said window shade has been fully unwound or fully wound, said switch means including;

a lead screw engaged to said drive shaft;

a nut threadedly engaged about said lead screw;

a contact pin affixed to and extending outward from said nut in a direction perpendicular to the longitudinal length of said lead screw;

a plate disposed in fixed relation to said lead screw, said plate defining an elongated slot sized to accept said contact pin extending therethrough, whereby said contact pin prevents said nut from rotating with said lead screw as the lead screw rotates so that the nut translates along the length of said lead screw as the lead screw rotates;

at least one limit switch mounted to said plate at ene end of said elongated slot, said limit switch having a switch contact for contact by said contact pin, whereby said limit switch is operable to send a signal to said motor when said contact pin engages said switch contact; and means for shutting said motor off in response to said signal from said limit switch.

12. The window shade conveyor system of claim 8, wherein:

said power means includes an electric motor.

* * * * *

UNITED STATES PATENT AND TRADEMARK OFFICE

CERTIFICATE OF CORRECTION

PATENT NO. : 5,016,701

DATED : May 21, 1991

INVENTOR(S) : Danny D. Vore

It is certified that error appears in the above-identified patent and that said Letters Patent is hereby corrected as shown below:

In column 11, line 44, please insert --includes-- following the word "roller" and before the word "second".

In column 13, line 11, please replace the word "piston" with --portion--.

Signed and Sealed this

Fifteenth Day of September, 1992

*Attest:*

DOUGLAS B. COMER

*Attesting Officer*

*Acting Commissioner of Patents and Trademarks*